US011078554B2

(12) United States Patent
Yang et al.

(10) Patent No.: US 11,078,554 B2
(45) Date of Patent: Aug. 3, 2021

(54) LIGHTWEIGHT STEEL AND STEEL SHEET WITH ENHANCED ELASTIC MODULUS, AND MANUFACTURING METHOD THEREOF

(71) Applicant: BAOSHAN IRON & STEEL CO., LTD., Shanghai (CN)

(72) Inventors: Qi Yang, Shanghai (CN); Li Wang, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 235 days.

(21) Appl. No.: 16/092,867

(22) PCT Filed: Mar. 30, 2017

(86) PCT No.: PCT/CN2017/078770
§ 371 (c)(1),
(2) Date: Oct. 11, 2018

(87) PCT Pub. No.: WO2017/173950
PCT Pub. Date: Oct. 12, 2017

(65) Prior Publication Data

US 2019/0144965 A1 May 16, 2019

(30) Foreign Application Priority Data

Apr. 5, 2016 (CN) ..... 201610209295.2

(51) Int. Cl.
*C21D 9/46* (2006.01)
*C22C 38/02* (2006.01)
(Continued)

(52) U.S. Cl.
CPC ..... *C21D 9/46* (2013.01); *B22D 11/001* (2013.01); *C21D 6/001* (2013.01); *C21D 6/002* (2013.01);
(Continued)

(58) Field of Classification Search
CPC ..... B22D 11/001; C21D 9/46; C21D 6/001; C21D 6/002; C21D 6/005; C21D 6/008;
(Continued)

(56) References Cited

U.S. PATENT DOCUMENTS 9,315,883 B2 * 4/2016 Liu ..... C21D 8/0236
2011/0277886 A1 * 11/2011 Xie ..... C22C 38/04 148/221
(Continued)

FOREIGN PATENT DOCUMENTS

CN 101563476 10/2009
CN 105838993 8/2016
(Continued)

OTHER PUBLICATIONS

Supplementary European Search Report dated Jul. 31, 2019 for European Application No. 17778614.2.
(Continued)

*Primary Examiner* — Scott R Kastler
(74) *Attorney, Agent, or Firm* — Thomas Horstemeyer, LLP

(57) ABSTRACT

There is disclosed a lightweight steel with an enhanced elastic modulus, wherein the lightweight steel has a chemical composition by mass percentage of 0.001%≤C≤0.30%, 0.05%≤Mn≤4.0%, 1.5%<Al<3.0%, 1.5%≤Ti≤7.0%, 0.5%≤B≤3.6%, and the remainder consisting of Fe and other unavoidable impurities. A microstructure of the lightweight steel comprises a matrix and fine hardening granules evenly distributed throughout the matrix. The matrix entirely or partially comprises a ferrite and/or a bainite. The hardening granule comprises at least $TiB_2$.

34 Claims, 4 Drawing Sheets

(51) Int. Cl.

| | |
|---|---|
| ***C22C 38/06*** | (2006.01) |
| ***C22C 38/08*** | (2006.01) |
| ***C22C 38/16*** | (2006.01) |
| ***C22C 38/04*** | (2006.01) |
| ***C22C 38/14*** | (2006.01) |
| ***C22C 38/12*** | (2006.01) |
| ***C22C 38/18*** | (2006.01) |
| ***C21D 8/02*** | (2006.01) |
| ***B22D 11/00*** | (2006.01) |
| ***C21D 6/00*** | (2006.01) |
| ***C22C 38/00*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |

(52) U.S. Cl.
CPC ..... *C21D 6/005* (2013.01); *C21D 6/008* (2013.01); *C21D 8/02* (2013.01); *C21D 8/0205* (2013.01); *C21D 8/0226* (2013.01); *C21D 8/0236* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/22* (2013.01); *C22C 38/26* (2013.01); *C22C 38/28* (2013.01); *C22C 38/32* (2013.01); *C22C 38/38* (2013.01); *C21D 2211/002* (2013.01); *C21D 2211/004* (2013.01); *C21D 2211/005* (2013.01)

(58) Field of Classification Search
CPC ..... C22C 38/04; C22C 38/06; C22C 38/08; C22C 38/12
See application file for complete search history.

(56) References Cited

U.S. PATENT DOCUMENTS

| | | | |
|---|---|---|---|
| 2013/0174942 | A1 | 7/2013 | Bonnet et al. |
| 2015/0247223 | A1 | 9/2015 | Cheng et al. |
| 2015/0360285 | A1 | 12/2015 | Dorner et al. |

FOREIGN PATENT DOCUMENTS

| | | |
|---|---|---|
| EP | 1897963 | 3/2008 |
| EP | 2703509 | 3/2014 |
| JP | 2003105505 | 4/2003 |
| JP | 3409301 | 5/2003 |
| JP | 2003328086 | 11/2003 |
| JP | 2010502838 | 1/2010 |
| JP | 2015533943 | 11/2015 |
| JP | 2015534605 | 12/2015 |
| WO | 2008029011 | 3/2008 |

OTHER PUBLICATIONS

1st Office Action dated Apr. 28, 2017 for Chinese Patent Application No. 201610209295.2.
Office Action for JP 2018552174 dated Oct. 1, 2019.
International Search Report & Written Opinion for PCT/CN2017/078770 dated Jun. 29, 2017.

* cited by examiner

LIGHTWEIGHT STEEL AND STEEL SHEET WITH ENHANCED ELASTIC MODULUS, AND MANUFACTURING METHOD THEREOF

CROSS-REFERENCE TO RELATED APPLICATIONS

This application is a 371 U.S. National Phase of PCT International Application No. PCT/CN2017/078770 filed on Mar. 30, 2017, which claims benefit and priority to Chinese patent application no. 201610209295.2, filed on Apr. 5, 2016. Both of the above-referenced applications are incorporated by reference herein in their entirety.

TECHNICAL FIELD

The disclosure relates to a lightweight steel, a steel sheet and a method of manufacturing the same, particularly to a lightweight steel featuring an enhanced elastic modulus, a steel sheet and a method of manufacturing the same.

BACKGROUND ART

Replacement of a traditional low-strength steel material with a high-strength steel material or an advanced high-strength steel material may increase the specific strength (a ratio of strength to density) of a vehicle steel and reduce the thickness of a steel sheet for structural components, so as to realize weight reduction of the body structure of a vehicle. A low-density, high-strength-and-toughness, aluminum-rich steel sheet under current research and development may further improve the specific strength of a steel sheet to meet the weight reduction requirement that is potentially more stringent.

However, despite the high specific strength of the aluminum-rich lightweight steel, the elastic modulus of the steel decreases as the aluminum content increases (for example, an Fe-8.5 wt % Al lightweight steel has an elastic modulus of about 170 GPa which is up to 17% lower than the elastic modulus of about 205 GPa that is exhibited by a conventional C—Mn steel). As known from the theory of mechanics of materials, for a given elastic modulus of a steel sheet material, the rigidity requirement of a component limits thinning of a high-strength steel sheet. Thus, to meet the rigidity requirement of the component, if the elastic modulus of the high-strength steel sheet material can be increased per se, further reduction of the steel sheet thickness and the vehicle body weight can be achieved without changing the shape of the component. Additionally, the increased elastic modulus of the high-strength steel can reduce resilience of the steel sheet during stamping molding, favorable for manufacturing stamped components having precise shapes. The decreased elastic modulus of the lightweight aluminum-rich steel significantly counteracts the weight reduction effect brought about by the decreased density and increased specific strength. Therefore, as the lightweight high-strength aluminum-rich steel is concerned, increasing its elastic modulus is one of the important factors that must be considered to develop new types of steel and promote their applications.

Addition of hard ceramic particles such as carbides, borides and the like (e.g. TiC, VC and $TiB_2$) into a steel matrix can increase the overall elastic modulus of a steel material. The reason is that the abovementioned ceramic particles have a high elastic modulus of about 300-565 GPa, far higher than the elastic modulus of a conventional steel sheet used for the matrix material. In addition, the abovementioned ceramic particles have a lower density than the conventional steel sheet. Thus, a steel based composite material formed by addition of the reinforcing particles also features lightweight. Studies show that $TiB_2$ particles are particularly suitable for a reinforcing phase of a steel sheet matrix, because a direct thermodynamic equilibrium relationship can be easily established between $TiB_2$ and iron or an iron-based alloy, and the two phases (the matrix and the $TiB_2$ reinforcing phase) form a coherent relationship at the phase interface. Moreover, the elastic modulus of $TiB_2$ particles is remarkably higher than that of carbide reinforcing particles.

In the prior art, a steel based composite material reinforced by particles (referred to hereafter as lightweight steel with an enhanced elastic modulus) is generally prepared by a powder metallurgical process, wherein a variety of metal powders are subjected to homogeneous mixing, compact molding and high-temperature sintering in sequence. Ceramics particles of $TiB_2$ and the like are formed in situ by chemical reactions of the variety of metal powders. However, this process has the following apparent drawbacks: powders are susceptible to contamination and oxidation before sintering such that good bonding between a steel matrix and ceramic particles cannot be formed at their interface; porosity remains inside the lightweight steel after sintering, thereby inducing stress concentration and premature failure of the material in service; the manufacture process is only suitable for production in small quantities, unable to satisfy the requirement of large-scale production in the automobile industry.

A lightweight steel with an enhanced elastic modulus may be produced in an industrial scale by in-situ reaction casting. According to this technical approach, hard reinforcing particles are formed in situ by eutectic reaction during solidification of molten steel. As a result, an appropriate volumetric fraction of fine hard reinforcing particles can be uniformly, dispersively distributed in the steel matrix. Furthermore, this process is also characterized by good compatibility between the particles and the matrix, as well as low manufacture cost of the material, etc. Nevertheless, in a cast microstructure of a lightweight steel prepared nowadays from a compositional system comprising Fe—Ti—B as a main component with suitable amounts of C, Mn, Al and Si elements added (wherein the Al content is no more than 1.5%), reinforcing particles of $TiB_2$ and the like tend to exhibit a continuous reticular distribution at ferrite grain boundaries, which affects post-processability and deformability of a cast blank.

SUMMARY

One of the objects of the disclosure is to provide a lightweight steel with an enhanced elastic modulus, which has such properties as a low density, a high specific strength, a high tensile strength and a high elastic modulus, can be produced in an industrial scale, and can suppress continuous distribution of hard reinforcing particles at grain boundaries in the matrix, so as to improve processability and deformability of the material, and impart good ductility.

To achieve the above object, the disclosure provides a lightweight steel with an enhanced elastic modulus, wherein the lightweight steel has a chemical composition by mass percentage of $0.001\% \leq C \leq 0.30\%$, $0.05\% \leq Mn \leq 4.0\%$, $1.5\% < Al < 3.0\%$, $1.5\% \leq Ti \leq 7.0\%$, $0.5\% \leq B \leq 3.6\%$, with a balance of Fe and unavoidable impurity elements; wherein the lightweight steel has a microstructure comprising a matrix and fine hard reinforcing particles dispersively distributed in the matrix uniformly, wherein the matrix is entirely or partially ferrite and/or bainite, wherein the hard reinforcing particles comprise at least $TiB_2$.

In the lightweight steel with an enhanced elastic modulus according to the disclosure, the unavoidable impurities are mainly S, P and N elements. P is a solid solution reinforcing element, but it may increase cold shortness of the steel and decrease plasticity of the steel, degrading cold bendability and weldability. Hence, it's desirable to control P≤0.02%. S renders hot shortness of the steel, decreases ductility and toughness of steel, deteriorating weldability, and degrades corrosion resistance of the steel. Hence, it's desirable to control S≤0.01%. N and Al form AlN. An excessive amount of coarse AlN will reduce thermoplasticity of the steel. Hence, it's desirable to control N≤0.01%.

The various chemical elements in the lightweight steel with an enhanced elastic modulus according to the disclosure are designed in accordance with the following principles:

C: C is a solid solution reinforcing element which can significantly increase the yield strength and tensile strength of a steel sheet. C is also an element for stabilizing austenite. It may be used to control and adjust the microstructure of the steel matrix. The microstructure may be entirely or partially ferrite and/or bainite. In addition, C and Ti can form hard TiC particles which can increase the elastic modulus of the lightweight steel. However, an unduly high C content will exasperate the weldability of the lightweight steel. Therefore, the C content in the lightweight steel is controlled at 0.001-0.30%.

Mn: Mn promotes formation of austenite and enhances stability of austenite. Hence, it may be used to control and adjust the microstructure of the steel matrix. Mn can enhance the hardenability of the steel matrix, and solid-solution strengthen the steel matrix, so as to increase the lightweight steel strength. Mn can also reduce or eliminate the hot shortness of the steel caused by S, thereby improving the hot processability of the lightweight steel. However, an unduly high Mn content will result in Mn segregation in a cast slab and an obvious distribution of a banded structure in a hot-rolled sheet, thereby finally reducing the overall mechanical properties of lightweight steel. Therefore, the Mn content in the lightweight steel is controlled at 0.05-4.0%.

Al: Al is an important alloy element in the disclosure. Addition of the Al element helps to improve the microstructure of a cast blank of the lightweight steel, reduce the continuous distribution of the hard reinforcing particles (mainly $TiB_2$ particles) at the grain boundaries in the matrix, and prevent a film-like hard reinforcing phase (such as $TiB_2$) from enclosing the grain boundaries in the matrix, thereby enhancing the post-processability and deformability of the material and increasing the elongation at break. In addition, Al may be added to decrease the density of the steel sheet, so as to further enhance the weight reduction effect of the lightweight steel. However, addition of an unduly high amount of Al may degrade the castability of the cast slab. Therefore, the Al content in the lightweight steel is controlled at 1.5-3.0%.

Ti: Ti is an important alloy element in the disclosure. It combines with B to form hard reinforcing particles of $TiB_2$ which mainly increase the elastic modulus of the lightweight steel. Additionally, Ti combines with C to form hard particles of TiC which may also be useful for increasing the elastic modulus of the lightweight steel. If the Ti content is lower than 1.5%, the $TiB_2$ particles formed in the steel matrix will have a low volumetric fraction, not sufficient to result in notable improvement of the elastic modulus of the lightweight steel. If the Ti content is higher than 7.0%, a primary phase of coarse $TiB_2$ particles tends to be generated in the steel matrix, having a negative impact on the castability and post-processability of the steel based composite material. Therefore, the Ti content in the lightweight steel is controlled at 1.5-7.0%.

B: B is also an important alloy element in the disclosure. It combines with Ti to form hard reinforcing particles of $TiB_2$ which mainly increase the elastic modulus of the steel based composite material. As known from stoichiometry, the B content is about 0.45 times the Ti content to form $TiB_2$ particles. Addition of an excessive amount of B will lead to formation of a hard phase of $Fe_2B$, thereby reducing steel ductility. Addition of an unduly low amount of B will lead to solid dissolution of a relatively large amount of Ti in the steel, thereby lowering the utility of Ti. Therefore, the B content in the lightweight steel is controlled at 0.5-3.6%.

Further, in the lightweight steel of the disclosure, Ti and B elements further meet: $-1.2\% \leq (Ti-2.22*B) \leq 1.2\%$.

In this formula, Ti and B represent mass percentages of Ti and B elements respectively. For example, when the Ti content is 1.6%, and the B content is 0.6%, the value of Ti put in the formula is 1.6, not 0.016; and the value of B put in the formula is 0.6, not 0.006.

In the above lightweight steel, the contents of Ti and B elements must meet $-1.2\% \leq (Ti-2.22*B) \leq 1.2\%$ at the same time. If $(Ti-2.22*B) > 1.2\%$, a relatively large amount of Ti will solid-dissolve in the steel matrix, resulting in decreased Ti utility; if $(Ti-2.22B) < -1.2\%$, the $Fe_2B$ hard phase will form in an excessive amount in the steel matrix, leading to apparently decreased steel ductility.

Still further, in the above lightweight steel, the volumetric fraction of the hard particles amounts to at least 3% of the whole microstructure.

In the above lightweight steel, when the contents of Ti and B elements meet $-1.2\% \leq (Ti-2.22*B) \leq 1.2\%$, the sum of the volumetric fractions of the hard reinforcing particles in the microstructure of the lightweight steel amounts to at least 3% of the whole microstructure, which can enhance the elastic modulus of the lightweight steel effectively. In this technical solution, it's important to control the lower limit of the proportion of the hard reinforcing particles, without particularly strict requirement of the upper limit. Generally, the sum of the volumetric fractions of the hard reinforcing particles may be controlled to amount to 3-25% of the whole microstructure. It's generally difficult to have this proportion exceed 25% in industrial production.

Still further, in the above lightweight steel, the lightweight steel has a tensile strength >500 MPa, an elastic modulus >200 GPa, and a density <7600 kg/m$^3$.

Preferably, in the above lightweight steel, the content of Ti element is $3.0\% \leq Ti \leq 6.0\%$; the content of B element is $1.2\% \leq B \leq 3.0\%$; Ti and B elements further meet: $-0.6\% \leq (Ti-2.22*B) \leq 0.6\%$; and the volumetric fraction of the hard particles amounts to at least 6% of the whole microstructure.

In the above lightweight steel, in the presence of a suitable amount of C, when $0.6\% < (Ti-2.22*B) \leq 0.2\%$, a relatively large amount of TiC particles will form in the steel matrix, thereby affecting the enhancing effect of the elastic modulus of the lightweight steel. When $-1.2\% \leq (Ti-2.22*B) < -0.6\%$, the $Fe_2B$ hard phase in the steel matrix will reduce the ductility of the lightweight steel. Preferably, the contents of Ti and B elements in the chemical composition of the lightweight steel according to the disclosure meet: $3.0\% \leq Ti \leq 6.0\%$, $1.2\% \leq B \leq 3.0\%$, such that the sum of the volumetric fractions of the reinforcing particles contained in the steel matrix is no less than 6%. At the same time, the contents of Ti and B elements preferably meet $-0.6\% \leq (Ti-2.22*B) \leq 0.6\%$, such that the reinforcing particles in the steel matrix is mainly $TiB_2$, thereby improving the effect of the hard particles in enhancing the elastic modulus of the lightweight steel.

Still further, in the above lightweight steel, the lightweight steel has a tensile strength >500 MPa, an elastic modulus >210 GPa, and a density <7400 kg/m$^3$.

Further, in the lightweight steel according to the disclosure or any of the solutions further defined above, the hard reinforcing particles further comprise at least one of TiC and $Fe_2B$.

Further, in the lightweight steel according to the disclosure or any of the solutions further defined above, the hard reinforcing particles have an average particle size of less than 15 μm.

In the disclosure, the amounts of the alloy elements are such that the hard reinforcing particles in the steel matrix mostly originate from eutectic reactions occurring when molten steel solidifies, wherein formation of a coarse primary phase is suppressed. As a result, the hard reinforcing particles can be distributed uniformly, finely in the steel matrix and, in turn, the lightweight steel has superior post-processability and mechanical properties. When the hard reinforcing particles have an average particle size of no more than 15 μm, the lightweight steel has a good elongation at break.

Further, in the lightweight steel according to the disclosure or any of the solutions further defined above, the chemical composition of the lightweight steel further comprises at least one of the following elements: $0.01\% \leq Si \leq 1.5\%$, $0.01\% \leq Cr \leq 2.0\%$, $0.01 \leq \%$ $Mo \leq 1.0\%$, $0.01\% \leq Nb \leq 0.2\%$, $0.01\% \leq V \leq 0.5\%$, $0.05\% \leq Ni \leq 1.0\%$, $0.05\% \leq Cu \leq 1.0\%$, $0.001\% \leq Ca \leq 0.2\%$.

The above chemical elements in the lightweight steel with an enhanced elastic modulus are designed in accordance with the following principles:

Si: Si is a solid solution strengthening element for ferrite, and can increase strength. In addition, addition of Si can improve the mechanical stability of austenite significantly, desirable for the lightweight steel to achieve good match between strength and plasticity. However, an unduly high Si content will reduce the plasticity of the lightweight steel. Additionally, for a hot galvanized lightweight steel sheet, an unduly high Si content will worsen the plateability of the lightweight steel substrate. Therefore, the Si content in the lightweight steel is controlled at 0.01-1.5%.

Cr: Cr can refine a grain structure and inhibit grain coarsening in the course of thermal processing, but an unduly high Cr content will damage the steel ductility. Therefore, the Cr content in the lightweight steel is controlled at 0.01-2.0%.

Mo: Mo has a function similar to that of Cr. An unduly high content of Mo element adds to production cost. Therefore, the Mo content in the lightweight steel is controlled at 0.01-1.0%.

Nb: Nb combines with C, N to form Nb(C, N), capable of effectively inhibiting grain coarsening in thermal processing. Nb may strongly inhibit dynamic recrystallization, thereby improving resistance to rolling deformation. Nb can refine ferrite grains. However, addition of Nb in an excessive amount will weaken the thermal processability of the lightweight steel and the toughness of a lightweight steel sheet. Therefore, the Nb content in the lightweight steel is controlled at 0.01-0.2%.

V: V helps to refine a grain structure and improve the thermal stability of the structure. V may also increase the strength of the lightweight steel. However, addition of V adds to the cost of the lightweight steel. Therefore, the V content in the lightweight steel is controlled at 0.01-0.5%.

Ni: Ni is an element for stabilizing austenite. It may impede grain coarsening at high temperatures. However, Ni will add to production cost due to its high price. Therefore, the Ni content in the lightweight steel is controlled at 0.05-1.0%.

Cu: Cu has a function similar to that of Ni. However, an unduly high amount of Cu is undesirable for thermal deformation processing. Therefore, the Cu content in the lightweight steel is controlled at 0.05-1.0%.

Ca: Ca is used to remove S to improve the heat processability of the lightweight steel. An unduly high amount of Ca will decrease the ductility of the lightweight steel. Therefore, the Ca content in the lightweight steel is controlled at 0.001-0.2%.

Another object of the disclosure is to provide a steel sheet made of the lightweight steel according to any one of the above solutions.

In order to fulfill the above inventive object, the disclosure further proposes a steel sheet which is made of the lightweight steel according to any one of the above solutions.

Still another object of the disclosure is to provide a manufacturing method for manufacturing the above steel sheet, wherein the method may use the lightweight steel according to any one of the above solutions to produce the above steel sheet.

In order to fulfill the above inventive object, the disclosure further proposes a method for manufacturing the above steel sheet, comprising the following steps:

(1) Smelting and continuous casting to obtain a slab having a thickness of 120-300 mm;

(2) Hot rolling to obtain a hot-rolled sheet.

Optionally, in the manufacturing method of the disclosure, Step (2) is followed by Step (3): recrystallization annealing.

The above solution takes into account that, if a non-recrystallized microstructure exists in the matrix of a hot-rolled sheet, the hot-rolled sheet is subjected to recrystallization annealing treatment to increase the ductility of the hot-rolled sheet, and provide the hot-rolled sheet with good rolling deformability for subsequent cold rolling deformation. If the structure of the hot-rolled sheet is a complete recrystallization structure, such that the hot-rolled steel sheet already has good cold rolling deformability and ductility, the recrystallization annealing step may be omitted.

Further, in the manufacturing method of the disclosure, in Step (2), a heating temperature is 1000-1250° C.; a soaking time is 0.5-3 h; a final rolling temperature is ≥850° C.; and coiling is then performed at 400-750° C.

Still further, in the manufacturing method of the disclosure, when the hot-rolled sheet is subjected to recrystallization annealing by way of continuous annealing in Step (3), the hot-rolled sheet is heated to a soaking temperature of 800-1000° C., held for 30-600 s, and then cooled to room temperature.

In the above solution, the ranges of the related parameters for the continuous annealing in Step (3) are chosen for the following reasons: if the soaking temperature is lower than 800° C. or the soaking time is less than 30 s, the structure of the matrix of the steel sheet will not recrystallize observably; if the soaking temperature is higher than 1000° C., the structure of the matrix of the steel sheet will coarsen rapidly, which, in turn, will affect its deformability in subsequent processes. A soaking time of no more than 600 s is set from a viewpoint of the economy of production.

Still further, in the above manufacturing method, when the hot-rolled sheet is subjected to recrystallization annealing by way of bell furnace annealing in Step (3), the hot-rolled sheet is heated to a soaking temperature of 650-900° C., held for 0.5-48 h, and then cooled to room temperature along with the furnace.

In the above solution, the ranges of the related parameters for the bell furnace annealing in Step (3) are chosen for the following reasons: if the soaking temperature is lower than 650° C. and the soaking time is less than 0.5 h, the structure of the matrix of the steel sheet will not recrystallize observably; if the soaking temperature is higher than 900° C., the structure of the matrix of the steel sheet will coarsen rapidly, which, in turn, will affect its deformability in subsequent processes. A soaking time of no more than 48 hours is set for the reason that an excessively long soaking time will affect the production efficiency.

Additionally, in order to fulfill the above inventive object, the disclosure further proposes another method for manufacturing the above steel sheet, comprising the following steps:

(1) Smelting and strip casting to obtain a thin strip having a thickness of no more than 10 mm;

(2) Hot rolling to obtain a hot-rolled sheet.

In the another method for manufacturing the above steel sheet according to the disclosure, a strip casting process is utilized in Step (1): a molten steel having a composition of the lightweight steel is infused into a gap between a pair of cooling rollers rotating conversely, wherein the molten steel solidifies between the two rollers to form a thin strip having a thickness of no more than 10 mm, and a cooling rate for the solidification is greater than 80° C./s. In the manufacture using the strip casting process, rapid solidification of the molten steel may prevent segregation of alloy elements, and allow hard reinforcing particles thus generated to distribute finely, uniformly in the matrix of the thin strip. Generally, the average particle size of the hard reinforcing particles can be refined to 10 μm or less. Fine and uniform distribution of the hard reinforcing particles and uniform distribution of the alloy elements are favorable for improvement of the ductility of the final lightweight steel. In addition, the thin strip prepared using the strip casting process may be hot rolled to a hot-rolled coil having a specified thickness without external heating, which greatly simplifies the process for producing strip steel, and thus reduces the production cost.

Optionally, in another manufacturing method of the disclosure, Step (2) is followed by Step (3): recrystallization annealing.

The above solution takes into account that, if a non-recrystallized microstructure exists in the matrix of a hot-rolled sheet, the hot-rolled sheet is subjected to recrystallization annealing treatment to increase the ductility of the hot-rolled sheet, and provide the hot-rolled sheet with good rolling deformability for subsequent cold rolling deformation. If the structure of the hot-rolled sheet is a complete recrystallization structure, such that the hot-rolled steel sheet already has good cold rolling deformability and ductility, the recrystallization annealing step may be omitted.

Further, in another manufacturing method of the disclosure, in Step (2), the thin strip is hot rolled immediately with no aid of external heating; a final rolling temperature is controlled at 2850° C.; a hot rolling reduction is 20-60%; and coiling is then performed at 400-750° C.

Still further, in said another manufacturing method of the disclosure, when the hot-rolled sheet is subjected to recrystallization annealing by way of continuous annealing in Step (3), the hot-rolled sheet is heated to a soaking temperature of 800-1000° C., held for 30-600 s, and then cooled to room temperature.

In the above solution, the ranges of the related parameters for the continuous annealing in Step (3) are chosen for the following reasons: if the soaking temperature is lower than 800° C. or the soaking time is less than 30 s, the structure of the matrix of the steel sheet will not recrystallize observably; if the soaking temperature is higher than 1000° C., the structure of the matrix of the steel sheet will coarsen rapidly, which, in turn, will affect its deformability in subsequent processes. A soaking time of no more than 600 s is set from a viewpoint of the economy of production.

Still further, in said another manufacturing method described above, when the hot-rolled sheet is subjected to recrystallization annealing by way of bell furnace annealing in Step (3), the hot-rolled sheet is heated to a soaking temperature of 650-900° C., held for 0.5-48 h, and then cooled to room temperature along with the furnace.

In the above solution, the ranges of the related parameters for the bell furnace annealing in Step (3) are chosen for the following reasons: if the soaking temperature is lower than 650° C. and the soaking time is less than 0.5 h, the structure of the matrix of the steel sheet will not recrystallize observably; if the soaking temperature is higher than 900° C., the structure of the matrix of the steel sheet will coarsen rapidly, which, in turn, will affect its deformability in subsequent processes. A soaking time of no more than 48 hours is set for the reason that an excessively long soaking time will affect the production efficiency.

Additionally, in order to fulfill the above inventive object, the disclosure further proposes still another method for manufacturing the above steel sheet, comprising the following steps:

(1) Smelting and continuous casting to obtain a slab having a thickness of 120-300 mm;

(2) Hot rolling;

(3) Pickling;

(4) Cold rolling to obtain a cold-rolled sheet;

(5) Recrystallization annealing of the cold-rolled sheet.

In still another method for manufacturing the above steel sheet according to the disclosure, after the cold rolling, a recrystallization annealing process is utilized in Step (5) to convert the deformed structure in the matrix of the steel sheet into an equiaxed recrystallized structure, thereby increasing the deformability of the steel sheet and its elongation at break.

Optionally, in still another manufacturing method of the disclosure. Step (2) is followed by Step (2a): post-hot-rolling recrystallization annealing.

The above solution takes into account that, if a non-recrystallized microstructure exists in the matrix of a hot-rolled sheet, the hot-rolled sheet is subjected to recrystallization annealing treatment to increase the ductility of the hot-rolled sheet, and provide the hot-rolled sheet with good rolling deformability for subsequent cold rolling deformation. If the structure of the hot-rolled sheet is a complete recrystallization structure, such that the hot-rolled steel sheet already has good cold rolling deformability, the recrystallization annealing step may be omitted.

Further, in still another manufacturing method of the disclosure, in Step (2), a heating temperature is 1000-1250° C.; a soaking time is 0.5-3 h; a final rolling temperature is ≥850° C.; and coiling is then performed at 400-750° C.

Still further, in still another manufacturing method of the disclosure, when the post-hot-rolling recrystallization annealing in Step (2a) is performed by way of continuous annealing, the hot-rolled sheet is heated to a soaking temperature of 800-1000° C., held for 30-600 s, and then cooled to room temperature.

In the above solution, the ranges of the related parameters for the continuous annealing in Step (2a) are chosen for the following reasons: if the soaking temperature is lower than 800° C. or the soaking time is less than 30 s, the structure of the matrix of the steel sheet will not recrystallize observably; if the soaking temperature is higher than 1000° C., the structure of the matrix of the steel sheet will coarsen rapidly, which, in turn, will affect its deformability in subsequent processes. A soaking time of no more than 600 s is set from a viewpoint of the economy of production.

Still further, in still another manufacturing method described above, when the post-hot-rolling recrystallization annealing in Step (2a) is performed by way of bell furnace annealing, the hot-rolled sheet is heated to a soaking temperature of 650-900° C., held for 0.5-48 h, and then cooled to room temperature along with the furnace.

In the above solution, the ranges of the related parameters for the bell furnace annealing in Step (2a) are chosen for the following reasons: if the soaking temperature is lower than 650° C. and the soaking time is less than 0.5 h, the structure of the matrix of the steel sheet will not recrystallize observably; if the soaking temperature is higher than 900° C., the structure of the matrix of the steel sheet will coarsen rapidly, which, in turn, will affect its deformability in subsequent processes. A soaking time of no more than 48 hours is set for the reason that an excessively long soaking time will affect the production efficiency.

Further, in still another manufacturing method of the disclosure, a cold rolling reduction is controlled at 25-75% in Step (4).

In Step (4) of the above solution, the pickled hot-rolled steel sheet is deformed by cold rolling to a specified thickness, wherein the cold rolling reduction is 25-75%, preferably 40-(60%. An increased cold rolling reduction may help to refine the microstructure of the matrix in a subsequent annealing process and increase the homogeneity of the structure of the annealed steel sheet, thereby improving the ductility of the annealed steel sheet. However, if the cold rolling reduction is too large, resistance of the material to deformation will become very high due to work hardening, such that it will be extremely difficult to prepare a cold-rolled steel sheet having a specified thickness and a good shape. Moreover, an unduly high cold rolling reduction will induce microcracking between the matrix and the hard reinforcing particles inside the steel sheet and, in turn, lead to failure of the material.

Further, in still another manufacturing method of the disclosure, when the cold-rolled sheet is subjected to recrystallization annealing by way of continuous annealing in Step (5), the cold-rolled sheet is heated to a soaking temperature of 700-900° C., held for 30-600 s, and then cooled to room temperature.

In the above solution, the ranges of the related parameters for the continuous annealing in Step (5) are chosen for the following reasons: if the soaking temperature is lower than 700° C. or the soaking time is less than 30 s, the deformed structure of the matrix of the steel sheet will not recrystallize observably; if the soaking temperature is higher than 900° C. the structure of the matrix of the steel sheet will coarsen rapidly after the recrystallization is completed, which, in turn, will affect the annealed steel sheet's elongation at break. A soaking time of no more than 600 s is set from a viewpoint of the economy of production.

Further, in still another manufacturing method of the disclosure, when the cold-rolled sheet is subjected to recrystallization annealing by way of bell furnace annealing in Step (5), the cold-rolled sheet is heated to a soaking temperature of 600-800° C., held for 0.5-48 h, and then cooled to room temperature along with the furnace.

In the above solution, the ranges of the related parameters for the bell furnace annealing in Step (5) are chosen for the following reasons: if the soaking temperature is lower than 600° C. and the soaking time is less than 0.5 h, the deformed structure of the matrix of the steel sheet will not recrystallize observably; if the soaking temperature is higher than 800° C., the deformed structure of the matrix of the steel sheet will coarsen rapidly after the recrystallization is completed, which, in turn, will affect the annealed steel sheet's elongation at break. A soaking time of no more than 48 hours is set for the reason that an excessively long soaking time will affect the production efficiency.

Additionally, in order to fulfill the above inventive object, the disclosure further proposes yet another method for manufacturing the above steel sheet, comprising the following steps:

(1) Smelting and strip casting to obtain a thin strip having a thickness of no more than 10 mm;

(2) Hot rolling;

(3) Pickling:

(4) Cold rolling to obtain a cold-rolled sheet;

(5) Recrystallization annealing of the cold-rolled sheet.

In yet another method for manufacturing the above steel sheet according to the disclosure, a strip casting process is utilized in Step (1): a molten steel having a composition of the lightweight steel is infused into a gap between a pair of cooling rollers rotating conversely, wherein the molten steel solidifies between the two rollers to form a thin strip having a thickness of no more than 10 mm, and a cooling rate for the solidification is greater than 80° C./s. In the manufacture using the strip casting process, rapid solidification of the molten steel may prevent segregation of alloy elements, and allow hard reinforcing particles thus generated to distribute finely, uniformly in the matrix of the thin strip. Generally, the average particle size of the hard reinforcing particles can be refined to 10 μm or less. Fine and uniform distribution of the hard reinforcing particles and uniform distribution of the alloy elements are favorable for improvement of the ductility of the final lightweight steel. In addition, the thin strip prepared using the strip casting process may be hot rolled to a hot-rolled coil having a specified thickness without external heating, which greatly simplifies the process for producing strip steel, and thus reduces the production cost. According to the strip casting process, the molten steel is directly cast into a thin strip which is not hot rolled or slightly hot rolled (1-2 passes), and then cold rolled to produce a cold rolled thin sheet.

In yet another method for manufacturing the above steel sheet according to the disclosure, after the cold rolling, a recrystallization annealing process is utilized in Step (5) to convert the deformed structure in the matrix of the steel sheet into an equiaxed recrystallized structure, thereby increasing the deformability of the steel sheet and its elongation at break.

Optionally, in yet another manufacturing method of the disclosure, Step (2) is followed by Step (2a): post-hot-rolling recrystallization annealing.

The above solution takes into account that, if a non-recrystallized microstructure exists in the matrix of a hot-rolled sheet, the hot-rolled sheet is subjected to recrystallization annealing treatment to increase the ductility of the hot-rolled sheet, and provide the hot-rolled sheet with good rolling deformability for subsequent cold rolling deformation. If the structure of the hot-rolled sheet is a complete recrystallization structure, such that the hot-rolled steel sheet already has good cold rolling deformability and ductility, the recrystallization annealing step may be omitted.

Further, in yet another manufacturing method of the disclosure, in Step (2), the thin strip is hot rolled immediately with no aid of external heating; a final rolling temperature is controlled at ≥850° C.; a hot rolling reduction is 20-60%; and coiling is then performed at 400-750° C.

Still further, in yet another manufacturing method of the disclosure, when the post-hot-rolling recrystallization annealing in Step (2a) is performed by way of continuous annealing, the hot-rolled sheet is heated to a soaking temperature of 800-1000° C., held for 30-600 s, and then cooled to room temperature.

In the above solution, the ranges of the related parameters for the continuous annealing in Step (2a) are chosen for the following reasons: if the soaking temperature is lower than 800° C. or the soaking time is less than 30 s, the structure of the matrix of the steel sheet will not recrystallize observably; if the soaking temperature is higher than 1000° C., the structure of the matrix of the steel sheet will coarsen rapidly, which, in turn, will affect its deformability in subsequent processes. A soaking time of no more than 600 s is set from a viewpoint of the economy of production.

Still further, in yet another manufacturing method described above, when the post-hot-rolling recrystallization annealing in Step (2a) is performed by way of bell furnace annealing, the hot-rolled sheet is heated to a soaking temperature of 650-900° C., held for 0.5-48 h, and then cooled to room temperature along with the furnace.

In the above solution, the ranges of the related parameters for the bell furnace annealing in Step (2a) are chosen for the following reasons: if the soaking temperature is lower than 650° C. and the soaking time is less than 0.5 h, the structure of the matrix of the steel sheet will not recrystallize observably; if the soaking temperature is higher than 900° C., the structure of the matrix of the steel sheet will coarsen rapidly which, in turn, will affect its deformability in subsequent processes. A soaking time of no more than 48 hours is set for the reason that an excessively long soaking time will affect the production efficiency.

Further, in yet another manufacturing method of the disclosure, a cold rolling reduction is controlled at 25-75% in Step (4).

In Step (4) of the above solution, the pickled hot-rolled steel sheet is deformed by cold rolling to a specified thickness, wherein the cold rolling reduction is 25-75%, preferably 40-60%. An increased cold rolling reduction may help to refine the structure of the matrix in a subsequent annealing process and increase the homogeneity of the structure of the annealed steel sheet, thereby improving the ductility of the annealed steel sheet. However, if the cold rolling reduction is too large, resistance of the material to deformation will become very high due to work hardening, such that it will be extremely difficult to prepare a cold-rolled steel sheet having a specified thickness and a good shape. Moreover, an unduly high cold rolling reduction will induce microcracking between the matrix and the hard reinforcing particles inside the steel sheet and, in turn, lead to failure of the material.

Further, in yet another manufacturing method of the disclosure, when the cold-rolled sheet is subjected to recrystallization annealing by way of continuous annealing in Step (5), the cold-rolled sheet is heated to a soaking temperature of 700-900° C., held for 30-600 s, and then cooled to room temperature.

In the above solution, the ranges of the related parameters for the continuous annealing in Step (S) are chosen for the following reasons: if the soaking temperature is lower than 700° C. or the soaking time is less than 30 s, the deformed structure of the matrix of the steel sheet will not recrystallize observably; if the soaking temperature is higher than 900° C., the structure of the matrix of the steel sheet will coarsen rapidly after the recrystallization is completed, which, in turn, will affect the annealed steel sheet's elongation at break. A soaking time of no more than 600 s is set from a viewpoint of the economy of production.

Further, in yet another manufacturing method of the disclosure, when the cold-rolled sheet is subjected to recrystallization annealing by way of bell furnace annealing in Step (5), the cold-rolled sheet is heated to a soaking temperature of 600-800° C., held for 0.5-48 h, and then cooled to room temperature along with the furnace.

In the above solution, the ranges of the related parameters for the bell furnace annealing in Step (5) are chosen for the following reasons: if the soaking temperature is lower than 600° C. and the soaking time is less than 0.5 h, the deformed structure of the matrix of the steel sheet will not recrystallize observably; if the soaking temperature is higher than 800° C., the deformed structure of the matrix of the steel sheet will coarsen rapidly after the recrystallization is completed, which, in turn, will affect the annealed steel sheet's elongation at break. A soaking time of no more than 48 hours is set for the reason that an excessively long soaking time will affect the production efficiency.

According to the disclosure, formation of hard reinforcing particles having a high elastic modulus and finely, dispersively distributed in the steel matrix is utilized to enhance the whole elastic modulus of the above steel sheet material, and impart a high strength and a high elongation at break to the above steel sheet. The microstructural features and macromechanical properties of the above steel sheet are achieved generally by control over the composition of the above lightweight steel in combination with the above manufacturing method.

The lightweight steel characterized by an enhanced elastic modulus, the steel sheet and the method for manufacturing the same according to the disclosure have the following beneficial effects:

1) Hard $TiB_2$ particles are mainly used in the lightweight steel of the disclosure to enhance the elastic modulus of the steel sheet. A thermodynamic equilibrium relationship can be easily established between $TiB_2$ and a lightweight steel matrix, and they form a coherent relationship at a phase interface. This means that the hard $TiB_2$ particles and the matrix can bond with each other strongly, and the lightweight steel has good processability and elongation at break (the hard particles and the matrix will not split easily). In addition, $TiB_2$ has a density lower than that of the matrix. Hence, the whole density of the lightweight steel is decreased. Accordingly, the specific elastic modulus (a ratio of elastic modulus to density) of the lightweight steel is enhanced notably.

2) According to the disclosure, Al is used as an alloy element to improve the cast structure of the lightweight steel comprising a hard phase as a secondary phase, and inhibit or reduce continuous distribution of the hard reinforcing particles of the secondary phase at the grain boundaries in the matrix of the lightweight steel, thereby significantly improving the processability of the lightweight steel and enhance the lightweight steel's elongation at break. Additionally, addition of Al can reduce the density of the lightweight steel and increase the specific elastic modulus of the lightweight steel.

3) The microstructure of the lightweight steel of the disclosure relies entirely or partially on ferrite and/or bainite as its matrix, wherein the hard particles of $TiB_2$ and the like contained therein has a volumetric fraction of 12% or more; the elastic modulus of the lightweight steel may be increased to 230 GPa or more; the density may be reduced to 7400 $kg/m^3$ or less; and the tensile strength of the steel sheet is >500 MPa. The steel sheet prepared according to the disclosure may be used for manufacture of automobile components to realize the object of further reduction of the weight of automobile structures.

4) When a continuous casting process is used to prepare a slab, the manufacturing method of the disclosure can be implemented on an existing production line for high-strength steel without considerable modification. Therefore, the manufacturing method of the disclosure has a promising prospect of commercialization and application.

5) When a thin strip is prepared by way of rapid solidification (i.e. a strip casting process), the manufacturing method of the disclosure allows for dispersive distribution of finer hard reinforcing particles (having an average particle size of less than 10 μm) throughout the matrix of the steel sheet, and also refining of the matrix structure. Similarly, the steel sheet has good hot processability and elongation at break. Therefore, the manufacturing method of the disclosure has a promising prospect of commercialization and application.

DETAILED DESCRIPTION

Figure 1:
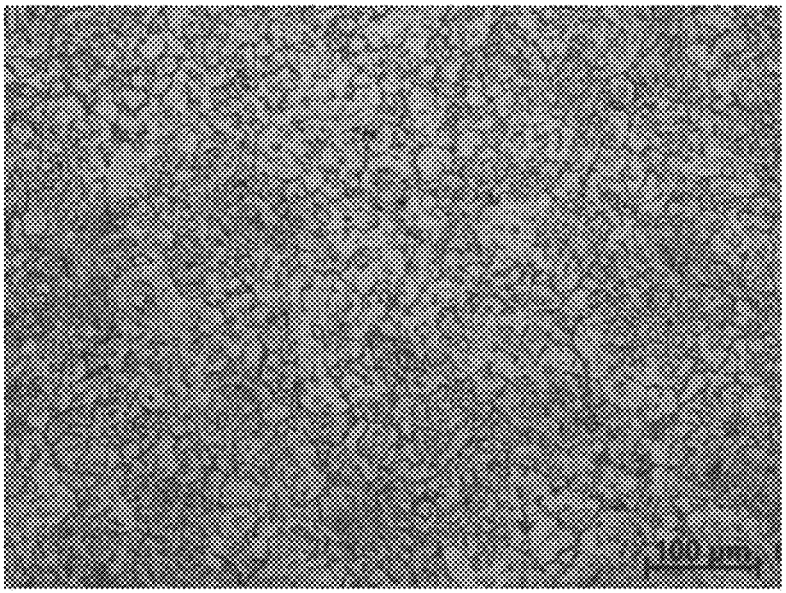
FIG. 1 is a photograph showing a low magnification metallographical structure of the slab of Comparative Example B2 of lightweight steel.

The lightweight steel with an enhanced elastic modulus, the steel sheet and the manufacturing method thereof according to the disclosure will be further explained and illustrated with reference to the accompanying drawings and the specific examples. Nonetheless, the explanation and illustration are not intended to unduly limit the technical solution of the disclosure.

Examples A1-A9 and Comparative Examples B1-B3 of Lightweight Steel

Table 1 lists the mass percentages of the chemical elements in Examples A1-A9 and Comparative Examples B1-B3 of the lightweight steel with an enhanced elastic modulus.

TABLE 1

(wt %)

| | C | Mn | Al | B | Ti | Nb | V | Cr | Mo | Ni | Cu | Si | Ca | N | S | P | Ti − 2.22*B |
|---|---|---|---|---|---|---|---|---|---|---|---|---|---|---|---|---|---|
| A1 | 0.15 | 2.1 | 2.0 | 0.5 | 1.5 | — | 0.4 | — | 0.9 | — | — | — | 0.2 | 0.003 | 0.005 | 0.004 | 0.39 |
| A2 | 0.05 | 4.0 | 2.4 | 1.2 | 3.5 | 0.2 | — | 1.4 | — | — | — | — | — | 0.003 | 0.004 | 0.010 | 0.84 |
| A3 | 0.10 | 0.8 | 2.8 | 2.1 | 4.8 | — | — | — | — | 1.0 | 1.0 | — | — | 0.008 | 0.001 | 0.006 | 0.14 |
| A4 | 0.15 | 3.0 | 2.3 | 1.1 | 3.0 | — | — | — | — | — | — | 1.2 | — | 0.003 | 0.002 | 0.008 | 0.56 |
| A5 | 0.26 | 1.0 | 2.0 | 2.6 | 6.9 | — | — | — | — | — | — | — | — | 0.004 | 0.002 | 0.007 | 1.13 |
| A6 | 0.04 | 0.05 | 2.5 | 2.0 | 4.2 | — | — | — | — | — | — | — | — | 0.002 | 0.005 | 0.003 | −0.24 |
| A7 | 0.005 | 0.1 | 1.6 | 2.3 | 4.9 | — | — | — | — | — | — | — | — | 0.003 | 0.001 | 0.009 | −0.21 |
| A8 | 0.08 | 0.5 | 2.9 | 2.2 | 4.3 | — | — | 0.4 | 0.1 | — | — | — | — | 0.003 | 0.002 | 0.008 | −0.58 |
| A9 | 0.06 | 0.1 | 1.8 | 3.6 | 6.8 | — | — | — | — | — | — | — | — | 0.007 | 0.009 | 0.01 | −1.19 |
| B1 | 0.006 | 0.2 | 2.5 | — | — | — | — | — | — | — | — | — | — | 0.004 | 0.003 | 0.014 | 0.0 |
| B2 | 0.04 | 0.05 | — | 2.3 | 4.0 | — | — | — | — | — | — | — | — | 0.003 | 0.004 | 0.012 | −1.11 |
| B3 | 0.1 | 0.1 | — | 1.9 | 5.2 | — | — | — | — | — | — | — | — | 0.003 | 0.008 | 0.007 | 0.98 |

Examples HM1-HM9 and Comparative Examples CS1-CS3 of Steel Sheets and the Method for Manufacturing the Same The steel sheets in the above Examples and Comparative Examples were manufactured with the following steps:

(1) The lightweight steel materials of A1-A9 in Table 1 were smelted and continuously cast according to Examples HM1-HM9 respectively, and the lightweight steel materials of B1-B3 in Table 1 were smelted and continuously cast according to Comparative Examples CS1-CS3 respectively, to obtain slabs of 120-300 mm in thickness, wherein S, P and N were unavoidable impurities, and the balance was Fe;

(2) Hot rolling to obtain hot rolled sheets of 3.2 mm in thickness: in this step, the heating temperature was 1000-1250° C., the soaking time was 0.5-3 h, the final rolling temperature was ≥850° C., and coiling was performed at 400-750° C.;

(3) Post-hot-rolling recrystallization annealing: when the hot-rolled sheet was subjected to recrystallization annealing by way of continuous annealing, the hot-rolled sheet was heated to a soaking temperature of 800-1000° C., held for 30-600 s, and then cooled to room temperature; when the hot-rolled sheet was subjected to recrystallization annealing by way of bell furnace annealing, the hot-rolled sheet was heated to a soaking temperature of 650-900° C., held for 0.5-48 h, and then cooled to room temperature along with the furnace.

The hot-rolled sheet in Step (2) was rapidly cooled to a coiling temperature and held for 1 hour, and then cooled to room temperature along with the furnace, so as to simulate the coiling and cooling processes of the hot-rolled sheet. In some Examples where a non-recrystallization microstructure did not exist in the hot-rolled sheet matrix, Step (3) might be exempted.

Table 2 lists the specific process parameters in the manufacturing method for the steel sheets in Examples HM1-HM9 and Comparative Examples CS1-CS3.

TABLE 2

| | Step (1) | | Step (2) | | | | Step (3) | | | |
|---|---|---|---|---|---|---|---|---|---|---|
| | | | | | | | Continuous Annealing | | Bell Furnace Annealing | |
| | Material | Thickness (mm) | Heating temperature (° C.) | soaking time (h) | Final rolling temperature (° C.) | Coiling Temperature (° C.) | Soaking temperature (° C.) | soaking time (s) | Soaking temperature (° C.) | soaking time (h) |
| HM1 | A1 | 120 | 1100 | 1.0 | 850 | 550 | — | — | 850 | 0.8 |
| HM2 | A2 | 120 | 1200 | 1.0 | 850 | 550 | 1000 | 30 | — | — |
| HM3 | A3 | 150 | 1180 | 1.5 | 900 | 600 | 800 | 600 | — | — |
| HM4 | A4 | 150 | 1230 | 1.5 | 880 | 750 | — | — | — | — |
| HM5 | A5 | 230 | 1230 | 2.5 | 850 | 550 | — | — | 650 | 48 |
| HM6 | A6 | 230 | 1250 | 2.5 | 910 | 700 | — | — | — | — |
| HM7 | A7 | 250 | 1200 | 2.5 | 880 | 600 | 900 | 300 | — | — |
| HM8 | A8 | 250 | 1230 | 2.5 | 880 | 580 | — | — | 750 | 5 |
| HM9 | A9 | 150 | 1200 | 1.5 | 880 | 600 | — | — | 700 | 24 |
| CS1 | B1 | 150 | 1100 | 1.5 | 900 | 650 | — | — | — | — |
| CS2 | B2 | 150 | 1200 | 1.5 | 900 | — | — | — | — | — |
| CSS | B3 | 150 | 1250 | 1.5 | 900 | — | — | — | — | — |

The steel sheets of the above Examples HM1-HM9 and Comparative Examples CS1-CS3 were sampled and subjected to various tests for properties including mechanical properties. The related data thus measured are listed in Table 3.

TABLE 3

| | Volumetric Fraction of Hard Reinforcing Particles (vol. %) | Tensile Mechanical Properties of Hot-rolled Sheet: Tensile Strength (MPa) | Elongation (%) | Density (kg/m$^3$) | Elastic Modulus (GPa) |
|---|---|---|---|---|---|
| HM1 | 3.6 | 540 | 28.6 | 7500 | 209 |
| HM2 | 7.1 | 675 | 15.2 | 7380 | 223 |
| HM3 | 11.5 | 610 | 20.2 | 7100 | 242 |
| HM4 | 6.5 | 618 | 17.8 | 7370 | 220 |
| HM5 | 15.8 | 696 | 13.6 | 7020 | 257 |
| HM6 | 11.2 | 580 | 20.1 | 7200 | 239 |
| HM7 | 12.8 | 603 | 18.9 | 7240 | 250 |
| HM8 | 10.2 | 586 | 22.4 | 7215 | 231 |
| HM9 | 15.3 | 675 | 15.4 | 7080 | 254 |
| CS1 | 0 | 372 | 39.8 | 7600 | 189 |
| CS2 | — | — | — | — | — |
| CS3 | — | — | — | — | — |

As seen from Table 3, the steel sheets have a tensile strength >500 MPa, a density <7600 kg/m$^3$, an elastic modulus >200 GPa. Thus, a hot-rolled lightweight steel sheet having a low density, a high tensile strength, a high elastic modulus and a good ductility can be obtained by designing the composition and process reasonably according to the disclosure.

Figure 2:
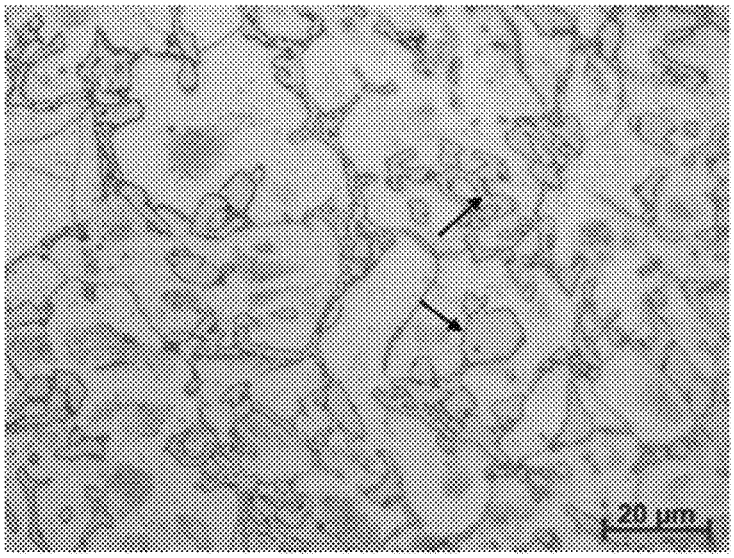
FIG. 2 is a photograph showing a high magnification metallographical structure of the slab of Comparative Example B2 of lightweight steel.
Figure 3:
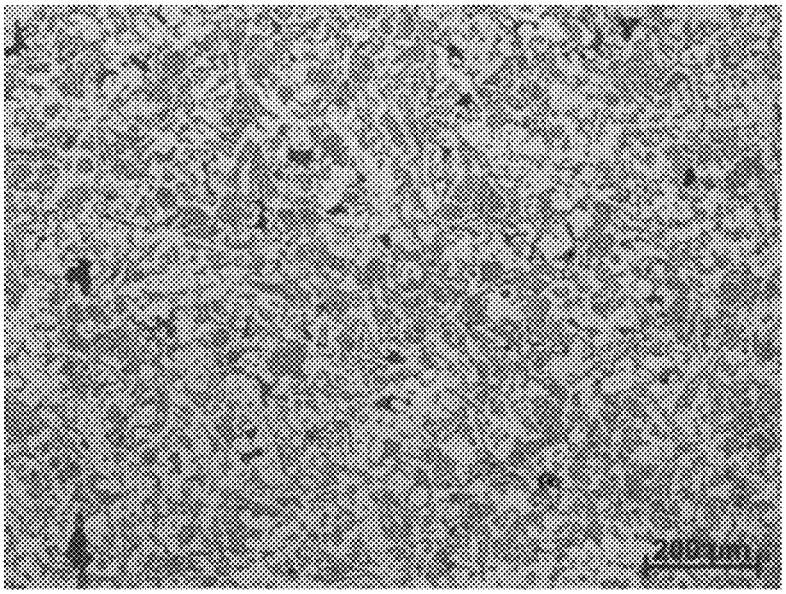
FIG. 3 is a photograph showing a low magnification metallographical structure of the slab of Example A6 of lightweight steel.
Figure 4:
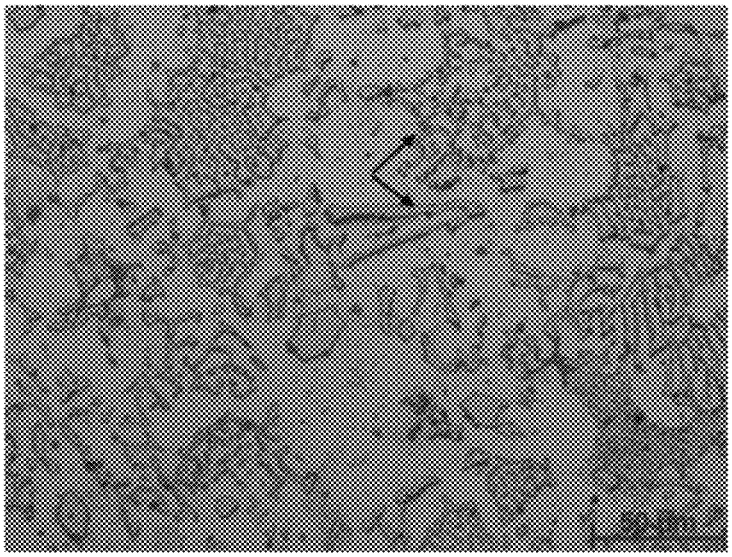
FIG. 4 is a photograph showing a high magnification metallographical structure of the slab of Example A6 of lightweight steel.

FIGS. 1 and 2 show the cast structure of the lightweight steel of Comparative Example B2 at low and high magnifications respectively; and FIGS. 3 and 4 show the cast structure of the lightweight steel of Example A6 at low and high magnifications respectively. The arrows in FIGS. 2 and 4 indicate the hard reinforcing particles.

As can be observed from FIGS. 1 and 2, in the slab microstructure of Comparative Example B2 of the lightweight steel, the ferrite matrix is enclosed by the continuously distributed hard reinforcing phase (mainly $TiB_2$ particles). As can be seen from FIGS. 3 and 4, the primary phase and the eutectic product (i.e. the hard reinforcing phase) in Example A6 of the lightweight steel distribute discretely in the ferrite matrix. In fact, similar phenomena were observed on Comparative Example B3 and Examples A1-A5, A7-A9 corresponding to Comparative Example B2 and Example A6 respectively. Comparative Examples B2-B3 are free of Al element, while Examples A1-A9 comprise Al element. Hence, addition of Al element is favorable for improving the microstructure of a lightweight steel cast slab, reducing continuous distribution of hard reinforcing particles at grain boundaries in the matrix, and inhibiting enclosure of the grain boundaries in the matrix by a film-like hard reinforcing phase.

Figure 5:
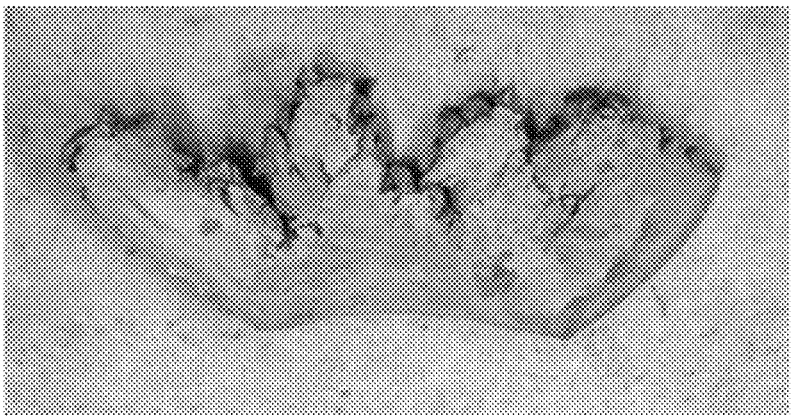
FIG. 5 is a photograph showing the morphology of the steel sheet of Comparative Example CS2 after hot rolling.
Figure 6:
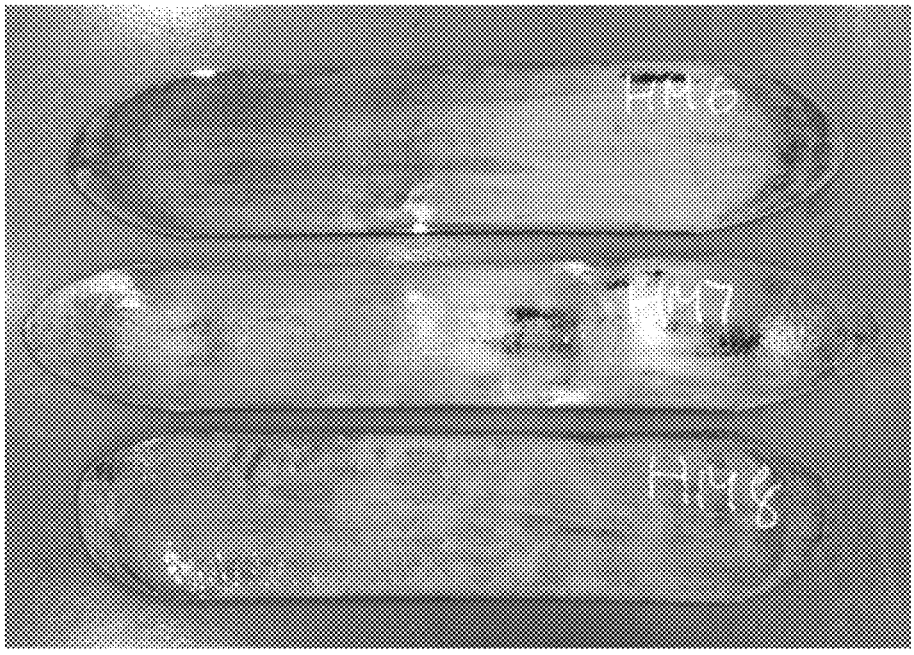
FIG. 6 is a photograph showing the morphologies of the steel sheets of Examples HM6-HM8 after hot rolling.

FIGS. 5 and 6 show the morphologies of the steel sheets in Comparative Example CS2 and Examples HM6-HM8 after hot rolling.

As can be observed from FIG. 5, the steel sheet of Comparative Example CS2 cannot be deformed well by hot rolling. As can be observed from FIG. 6, the steel sheets of Examples HM6-HM8 can be hot rolled to desired thicknesses. In fact, similar phenomena were observed on Comparative Example CS3 and Examples HM1-HM5, HM9 corresponding to Comparative Example CS2 and Examples HM6-HM8 respectively. Comparative Examples CS2-CS3 are free of Al element, while Examples HM1-HM9 comprise Al element. Hence, addition of Al element is favorable for hot rolling deformability of a steel sheet.

Figure 7:
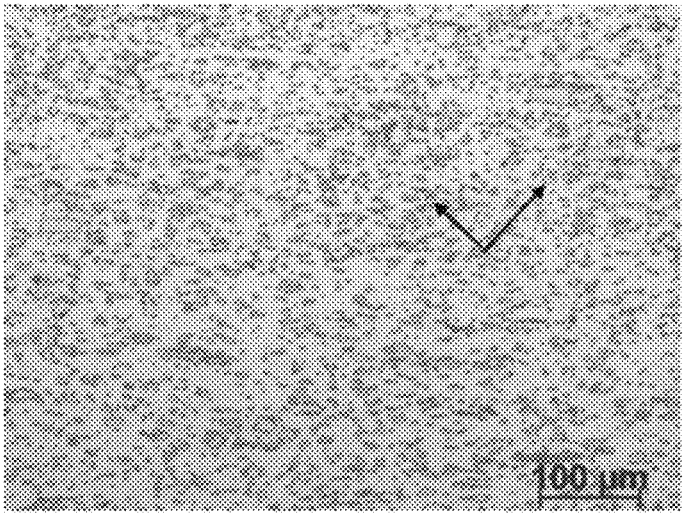
FIG. 7 is a photograph showing a low magnification metallographical structure of the steel sheet of Example HM6 after hot rolling.
Figure 8:
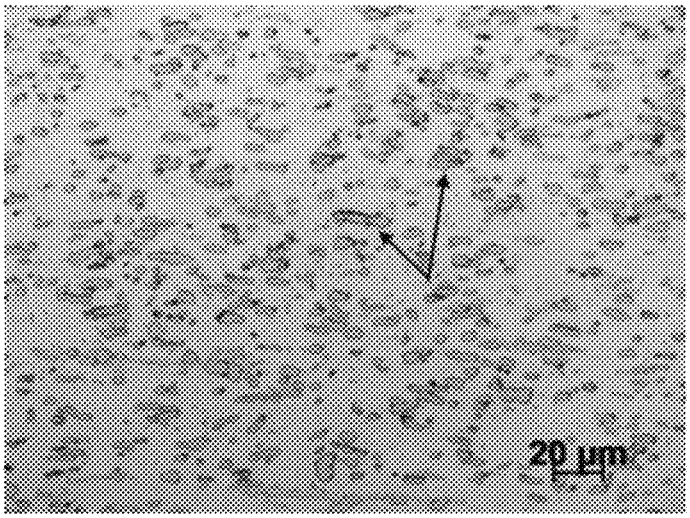
FIG. 8 is a photograph showing a high magnification metallographical structure of the steel sheet of Example HM6 after hot rolling.

FIGS. 7 and 8 show the microstructure of the steel sheet of Example HM6 after hot rolling at low and high magnifications respectively. The arrows in FIGS. 7 and 8 indicate the hard reinforcing particles.

The distribution of the hard reinforcing particles in the ferrite matrix of the hot-rolled sheet is observable in FIGS. 7 and 8. It's shown that the elongate hard reinforcing phase in the cast structure is broken and refined due to thermodynamic deformation.

Examples HM10-HM13 of Method for Manufacturing Steel Sheets

The steel sheets in the above Examples were manufactured with the following steps:

(1) A lightweight steel material shown in Table 1 was smelted, and the resulting molten steel was cast by way of strip casting and rolled into a thin strip having a thickness of no more than 10 mm, wherein S, P and N were unavoidable impurities, the balance being Fe; and the cooling rate for solidifying the molten steel was about 320° C./s;

(2) Hot rolling to obtain a hot-rolled sheet of 1.3 mm in thickness: the thin strip was hot rolled immediately with no aid of external heating, wherein the final rolling temperature was controlled at ≥850° C., the hot rolling reduction was 20-60%, and coiling was then performed at 400-750° C.;

(3) Post-hot-rolling recrystallization annealing: when the hot-rolled sheet was subjected to recrystallization annealing by way of continuous annealing, the hot-rolled sheet was heated to a soaking temperature of 800-1000° C., held for 30-600 s, and then cooled to room temperature; when the hot-rolled sheet was subjected to recrystallization annealing by way of bell furnace annealing, the hot-rolled sheet was heated to a soaking temperature of 650-900° C., held for 0.5-48 h, and then cooled to room temperature along with the furnace.

Table 4 lists the specific process parameters in the method for manufacturing the steel sheets of Examples HM10-HM13.

TABLE 4

| | Step (1) | | Step (2) | | | Step (3) | | | |
|---|---|---|---|---|---|---|---|---|---|
| | | | | | | Continuous Annealing | | Bell Furnace Annealing | |
| | Material | Thickness (mm) | Hot Rolling Reduction (%) | Final rolling temperature (° C.) | Coiling Temperature (° C.) | Soaking temperature (° C.) | soaking time (s) | Soaking temperature (° C.) | soaking time (h) |
| HM10 | A6 | 2.5 | 48 | 900 | 720 | — | — | — | — |
| HM11 | A2 | 3.2 | 59.4 | 860 | 550 | — | — | 750 | 8 |
| HM12 | A8 | 3.2 | 59.4 | 880 | 600 | 900 | 400 | — | — |
| HM13 | A5 | 2.0 | 35 | 900 | 640 | 850 | 600 | — | — |

The steel sheets of the above Examples HM10-HM13 were sampled and subjected to various tests for properties including mechanical properties. The related data thus measured are listed in Table 5.

TABLE 5

| | Volumetric Fraction of Hard | Tensile Mechanical Properties of Hot-rolled Sheet | | | |
|---|---|---|---|---|---|
| | Reinforcing Particles (vol. %) | Tensile Strength (MPa) | Elongation (%) | Density (kg/m$^3$) | Elastic Modulus (GPa) |
| HM10 | 10.7 | 612 | 20.4 | 7200 | 236 |
| HM11 | 7.8 | 680 | 13.6 | 7380 | 228 |
| HM12 | 11.0 | 574 | 20.6 | 7215 | 235 |
| HM13 | 16.4 | 708 | 11.9 | 7020 | 250 |

Meanwhile, metallographical examination on the above Examples HM10-HM13 shows that the matrix of the hot-rolled sheets is an equiaxed ferrite structure, and the average particle size of the hard reinforcing particles of mainly $TiB_2$ distributed in the matrix is about 3-5 μm.

Examples HM14-HM18 of Method for Manufacturing Steel Sheets

The steel sheets in the above Examples were manufactured with the following steps:

(1) In Examples HM14-HM18, the lightweight steel materials corresponding to A1, A3, A5, A6 and A9 in Table 1 were respectively smelted and continuously cast to obtain slabs of 120-300 mm in thickness, wherein S, P and N were unavoidable impurities, the balance being Fe;

(2) Hot rolling to obtain hot rolled sheets: the heating temperature was 1000-1250° C., the soaking time was 0.5-3 h, the final rolling temperature was ≥850° C., and coiling was performed at 400-750° C.;

(3) Post-hot-rolling recrystallization annealing: when the hot-rolled sheets were subjected to recrystallization annealing by way of continuous annealing, the hot-rolled sheets were heated to a soaking temperature of 800-1000° C., held for 30-600 s, and then cooled to room temperature; when the hot-rolled sheets were subjected to recrystallization annealing by way of bell furnace annealing, the hot-rolled sheets were heated to a soaking temperature of 650-900° C., held for 0.5-48 h, and then cooled to room temperature along with the furnace;

(4) Pickling, (5) Cold rolling: the cold rolling reduction was controlled at 25-75%;

(6) Recrystallization annealing of cold-rolled sheets: when the post-cold-rolling recrystallization annealing was performed by way of continuous annealing, the cold-rolled sheets were heated to a soaking temperature of 700-900° C., held for 30-600 s, and then cooled to room temperature; when the post-cold-rolling recrystallization annealing was performed by way of bell furnace annealing, the cold-rolled sheets were heated to a soaking temperature of 600-800° C., held for 0.5-48 h, and then cooled to room temperature along with the furnace.

Table 6 lists the specific process parameters in the method for manufacturing the steel sheets of Examples HM14-HM18.

TABLE 6

| | Step (1) | | Step (2) | | | | Step (3) | | | |
|---|---|---|---|---|---|---|---|---|---|---|
| | | | | | | | Continuous Annealing | | Bell Furnace Annealing | |
| | | | Heating | soaking | Final rolling | Coiling | Soaking | soaking | Soaking | holding |
| | Material | Thickness (mm) | Temperature (° C.) | time (h) | Temperature (° C.) | Temperature (° C.) | Temperature (° C.) | time (s) | Temperature (° C.) | Time (h) |
| HM14 | A1 | 120 | 1100 | 1.0 | 850 | 550 | — | — | 850 | 0.8 |
| HM15 | A3 | 150 | 1180 | 1.5 | 900 | 600 | — | — | 650 | 48 |
| HM16 | A5 | 230 | 1230 | 2.5 | 850 | 550 | 800 | 600 | — | — |
| HM17 | A6 | 230 | 1250 | 2.5 | 910 | 700 | — | — | — | — |
| HM18 | A9 | 150 | 1200 | 1.5 | 880 | 600 | — | — | 700 | 24 |

| | Step (5) | Step (6) | | | |
|---|---|---|---|---|---|
| | | Continuous Annealing | | Bell Furnace Annealing | |
| | Cold Rolling Reduction (%) | Soaking temperature (° C.) | soaking time (s) | Soaking temperature (° C.) | soaking time (h) |
| HM14 | 56.3 | — | — | 730 | 4.0 |
| HM15 | 56.3 | 850 | 600 | — | — |
| HM16 | 59.4 | — | — | 700 | 48 |
| HM17 | 59.4 | 900 | 240 | — | — |
| HM18 | 59.4 | — | — | 720 | 36 |

The steel sheets of the above Examples HM14-HM18 were sampled and subjected to various tests for properties including mechanical properties. The related data thus measured are listed in Table 7.

TABLE 7

| | Volumetric Fraction of Hard Reinforcing Particles (vol. %) | Tensile Mechanical Properties of Cold-rolled Sheet: Tensile Strength (MPa) | Elongation (%) | Density (kg/m$^3$) | Elastic Modulus (GPa) |
|---|---|---|---|---|---|
| HM14 | 3.6 | 560 | 33.2 | 7500 | 204 |
| HM15 | 11.5 | 601 | 21.8 | 7100 | 241 |
| HM16 | 15.8 | 670 | 14.8 | 7020 | 252 |
| HM17 | 11.2 | 607 | 22.4 | 7200 | 243 |
| HM18 | 15.3 | 696 | 14.7 | 7080 | 259 |

As seen from Table 7, the steel sheets have a tensile strength >500 MPa, and an elastic modulus >200 GPa. Thus, a hot-rolled lightweight steel sheet having a low density, a high tensile strength, a high elastic modulus and a good ductility can be obtained according to the disclosure.

Examples HM19-HM22 of Method for Manufacturing Steel Sheets

The steel sheets in the above Examples were manufactured with the following steps:

(1) A lightweight steel material shown in Table 1 was smelted, and the resulting molten steel was cast by way of strip casting and rolled into a thin strip having a thickness of no more than 10 mm, wherein S, P and N were unavoidable impurities, the balance being Fe; and the cooling rate for solidifying the molten steel was about 200° C./s;

(2) Hot rolling to obtain a hot-rolled sheet: the thin strip was hot rolled immediately with no aid of external heating, wherein the final rolling temperature was controlled at ≥850° C., the hot rolling reduction was 20-60%, and coiling was then performed at 400-750° C.;

(3) Post-hot-rolling recrystallization annealing: when the post-hot-rolling recrystallization annealing was performed by way of continuous annealing, the hot-rolled sheet was heated to a soaking temperature of 800-1000° C., held for 30-600 s, and then cooled to room temperature; when the post-hot-rolling recrystallization annealing was performed by way of bell furnace annealing, the hot-rolled sheet was heated to a soaking temperature of 650-900° C., held for 0.5-48 h, and then cooled to room temperature along with the furnace;

(4) Pickling;

(5) Cold rolling: in this step, the cold rolling reduction was controlled at 25-75%;

(6) Recrystallization annealing of cold-rolled sheets: when the post-cold-rolling recrystallization annealing was performed by way of continuous annealing, the cold-rolled sheets were heated to a soaking temperature of 700-900° C., held for 30-600 s, and then cooled to room temperature; when the post-cold-rolling recrystallization annealing was performed by way of bell furnace annealing, the cold-rolled sheets were heated to a soaking temperature of 600-800° C., held for 0.5-48 h, and then cooled to room temperature along with the furnace.

Table 8 lists the specific process parameters in the method for manufacturing the steel sheets of Examples HM19-HM22.

TABLE 8

| | Step (1) | | Step (2) | | | Step (3) | | | |
|---|---|---|---|---|---|---|---|---|---|
| | | | | | | Continuous Annealing | | Bell Furnace Annealing | |
| | Material | Thickness (mm) | Hot Roiling Reduction (%) | Final rolling temperature (° C.) | Coiling Temperature (° C.) | Soaking temperature (° C.) | soaking time (s) | Soaking temperature (° C.) | soaking time (h) |
| HM19 | A5 | 4.0 | 40 | 900 | 600 | — | — | 700 | 18 |
| HM20 | A2 | 4.5 | 46.7 | 880 | 720 | — | — | — | — |
| HM21 | A6 | 4.0 | 40 | 900 | 680 | 900 | 600 | — | — |
| HM22 | A8 | 3.6 | 33.3 | 880 | 580 | — | — | 720 | 8 |

| | Step (5) | Step (6) | | | |
|---|---|---|---|---|---|
| | | Continuous Annealing | | Bell Furnace Annealing | |
| | Cold Rolling Reduction (%) | Soaking temperature (° C.) | soaking time (s) | Soaking temperature (° C.) | soaking time (h) |
| HM19 | 50 | 900 | 420 | — | — |
| HM20 | 44 | 850 | 600 | — | — |
| HM21 | 50 | — | — | 700 | 8 |
| HM22 | 44 | — | — | 740 | 6 |

The steel sheets of the above Examples HM19-HM22 were sampled and subjected to various tests for properties including mechanical properties. The related data thus measured are listed in Table 9.

TABLE 9

| | Volumetric Fraction of Hard Reinforcing Particles (vol. %) | Tensile Mechanical Properties of Cold-rolled Sheet | | | |
|---|---|---|---|---|---|
| | | Tensile Strength (MPa) | Elongation (%) | Density (kg/m$^3$) | Elastic Modulus (GPa) |
| HM19 | 14.6 | 692 | 15.4 | 7020 | 248 |
| HM20 | 8.2 | 643 | 14.8 | 7380 | 230 |
| HM21 | 10.9 | 607 | 18.9 | 7200 | 234 |
| HM22 | 11.9 | 582 | 19.4 | 7215 | 240 |

Metallographical examination on the above Examples HM19-HM22 shows that the matrix of the annealed cold-rolled sheets is an equiaxed ferrite structure, and the average particle size of the hard reinforcing particles of mainly $TiB_2$ distributed in the matrix is about 3-6 μm.

It is to be noted that there are listed above only specific examples of the invention. Obviously, the invention is not limited to the above examples. Instead, there exist many similar variations. All variations derived or envisioned directly from the disclosure of the invention by those skilled in the art should be all included in the protection scope of the invention.

What is claimed is:

1. A lightweight steel with an enhanced elastic modulus, wherein:

the lightweight steel has a chemical composition by mass percentage of 0.001%≤C≤0.30%, 0.05%≤Mn≤4.0%, 1.6%≤Al≤2.9%, 1.5%≤Ti≤7.0%, 0.5%≤B≤3.6%, at least one of the elements: 0.01%≤Si≤1.5%, 0.01%≤Cr≤2.0%, 0.01%≤Mo≤1.0%, 0.01%≤Nb≤0.2%, 0.01%≤V≤0.5%, 0.05%≤Ni≤1.0%, 0.05%≤Cu≤1.0%, and 0.001%≤Ca≤0.2%, and with a balance of Fe and unavoidable impurity elements;

the lightweight steel has a microstructure comprising a matrix and fine hard reinforcing particles dispersedly distributed in the matrix uniformly, wherein the matrix is entirely or partially ferrite and/or bainite, wherein the hard reinforcing particles comprise at least $TiB_2$; and wherein the lightweight steel has a tensile strength >500 MPa, an elastic modulus >200 GPa, and a density <7600 kg/m$^3$.

2. The lightweight steel of claim 1, wherein the Ti and B elements further meet: −1.2%≤(Ti-2.22*B)≤1.2%.

3. The lightweight steel of claim 2, wherein the hard particles have a volumetric fraction amounting to at least 3% of the whole microstructure.

4. The lightweight steel of claim 2, wherein the Ti element has a content of 3.0%≤Ti≤6.0%; the B element has a content of 1.2%≤B3.0%; the Ti and B elements further meet: −0.6%≤(Ti −2.22*B)≤0.6%; and the hard particles have a volumetric fraction amounting to at least 6% of the whole microstructure.

5. The lightweight steel of claim 4, wherein the lightweight steel has a tensile strength >500 MPa, an elastic modulus >210 GPa, and a density <7400 kg/m$^3$.

6. The lightweight steel of claim 1, wherein the hard reinforcing particles further comprise at least one of TiC and $Fe_2B$.

7. The lightweight steel of claim 1, wherein the hard reinforcing particles have an average particle size of less than 15 μm.

8. A steel sheet made of the lightweight steel according to claim 1.

9. A manufacturing method for the steel sheet of claim 8, comprising the following steps:

(1) Smelting and continuous casting to obtain a slab having a thickness of 120-300 mm; and (2) Hot rolling to obtain a hot-rolled sheet.

10. The manufacturing method of claim 9, wherein Step (2) is followed by Step (3): recrystallization annealing.

11. The manufacturing method of claim 9, wherein, in Step (2), a heating temperature is 1000-1250° C.; a soaking time is 0.5-3 h; a final rolling temperature is ≥850° C.; and coiling is performed at 400-750° C.

12. The manufacturing method of claim 10, wherein, when the hot-rolled sheet is subjected to recrystallization annealing by way of continuous annealing in Step (3), the hot-rolled sheet is heated to a soaking temperature of 800-1000° C., held for 30-600s, and then cooled to room temperature.

13. The manufacturing method of claim 10, wherein, when the hot-rolled sheet is subjected to recrystallization annealing by way of bell furnace annealing in Step (3), the hot-rolled sheet is heated to a soaking temperature of 650-900° C., held for 0.5-48 h, and then cooled to room temperature along with the furnace.

14. A manufacturing method for the steel sheet of claim 8, comprising the following steps:

(1) Smelting and strip casting to obtain a thin strip having a thickness of no more than 10 mm; and (2) Hot rolling to obtain a hot-rolled sheet.

15. The manufacturing method of claim 14, wherein Step (2) is followed by Step (3): recrystallization annealing.

16. The manufacturing method of claim 14, wherein, in Step (2), the thin strip is hot rolled immediately with no aid of external heating; a final rolling temperature is controlled at ≥850° C.; a hot rolling reduction is 20-60%; and coiling is then performed at 400–750° C.

17. The manufacturing method of claim 15, wherein, when the hot-rolled sheet is subjected to recrystallization annealing by way of continuous annealing in Step (3), the hot-rolled sheet is heated to a soaking temperature of 800-1000° C., held for 30-600s, and then cooled to room temperature.

18. The manufacturing method of claim 15, wherein, when the hot-rolled sheet is subjected to recrystallization annealing by way of bell furnace annealing in Step (3), the hot-rolled sheet is heated to a soaking temperature of 650-900° C., held for 0.5-48 h, and then cooled to room temperature along with the furnace.

19. A manufacturing method for the steel sheet of claim 8, comprising the following steps:

(1) Smelting and continuous casting to obtain a slab having a thickness of 120-300 mm;

(2) Hot rolling;

(3) Pickling;

(4) Cold rolling to obtain a cold-rolled sheet; and (5) Recrystallization annealing of the cold-rolled sheet.

20. The manufacturing method of claim 19, wherein Step (2) is followed by a post-hot-rolling recrystallization annealing.

21. The manufacturing method of claim 19, wherein, in Step (2), a heating temperature is 1000-1250° C.; a soaking time is 0.5-3 h; a final rolling temperature is ≤850° C.; and coiling is then performed at 400-750° C.

22. The manufacturing method of claim 20, wherein, when the post-hot-rolling recrystallization annealing is performed by a continuous annealing, the hot-rolled sheet is heated to a soaking temperature of 800-1000° C., held for 30-600s, and then cooled to room temperature.

23. The manufacturing method of claim 20, wherein, when the post-hot-rolling recrystallization annealing is performed by a bell furnace annealing, the hot-rolled sheet is heated to a soaking temperature of 650-900° C., held for 0.5-48 h, and then cooled to room temperature along with the furnace.

24. The manufacturing method of claim 19, wherein a cold rolling reduction is controlled at 25-75% in Step (4).

25. The manufacturing method of claim 19, wherein, when the recrystallization annealing of the cold-rolled sheet is performed by a continuous annealing in Step (5), the cold-rolled sheet is heated to a soaking temperature of 700-900° C., held for 30-600s, and then cooled to room temperature.

26. The manufacturing method of claim 19, wherein, when the recrystallization annealing of the cold-rolled sheet is performed by a bell furnace annealing in Step (5), the cold-rolled sheet is heated to a soaking temperature of 600-800° C., held for 0.5-48 h, and then cooled to room temperature along with the furnace.

27. A manufacturing method for the steel sheet of claim 8, comprising the following steps:

(1) Smelting and strip casting to obtain a thin strip having a thickness of no more than 10 mm;

(2) Hot rolling;

(3) Pickling;

(4) Cold rolling to obtain a cold-rolled sheet; and (5) Recrystallization annealing of the cold-rolled sheet.

28. The manufacturing method of claim 27, wherein Step (2) is followed by a post-hot-rolling recrystallization annealing.

29. The manufacturing method of claim 27, wherein, in Step (2), the thin strip is hot rolled immediately with no aid of external heating; a final rolling temperature is controlled at ≥850° C.; a hot rolling reduction is 20-60%; and coiling is then performed at 400-750° C.

30. The manufacturing method of claim 28, wherein, when the post-hot-rolling recrystallization annealing is performed by a continuous annealing, the hot-rolled sheet is heated to a soaking temperature of 800-1000° C., held for 30-600s, and then cooled to room temperature.

31. The manufacturing method of claim 28, wherein, when the post-hot-rolling recrystallization annealing is performed by a bell furnace annealing, the hot-rolled sheet is heated to a soaking temperature of 650-900° C., held for 0.5-48 h, and then cooled to room temperature along with the furnace.

32. The manufacturing method of claim 27, wherein a cold rolling reduction is controlled at 25-75% in Step (4).

33. The manufacturing method of claim 27, wherein, when the recrystallization annealing of the cold-rolled sheet is performed by a continuous annealing in Step (5), the cold-rolled sheet is heated to a soaking temperature of 700-900° C., held for 30-600s, and then cooled to room temperature.

34. The manufacturing method of claim 27, wherein, when the recrystallization annealing of the cold-rolled sheet is performed by a bell furnace annealing in Step (5), the cold-rolled sheet is heated to a soaking temperature of 600-800° C., held for 0.5-48 h, and then cooled to room temperature along with the furnace.

* * * * *